US006336401B1

(12) United States Patent
Hasebe

(10) Patent No.: US 6,336,401 B1
(45) Date of Patent: Jan. 8, 2002

(54) STENCIL PRINTER

(75) Inventor: Daisuke Hasebe, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/599,444

(22) Filed: Jun. 22, 2000

(30) Foreign Application Priority Data

Jun. 23, 1999 (JP) ..... 11-176338
Mar. 28, 2000 (JP) ..... 12-088757

(51) Int. Cl.[7] ..... B41L 13/06

(52) U.S. Cl. ..... 101/118; 101/119; 101/120; 101/116

(58) Field of Search ..... 101/118, 119, 101/120, 116, 129

(56) References Cited

U.S. PATENT DOCUMENTS 5,572,928 A * 11/1996 Negishi ..... 101/119
5,845,571 A * 12/1998 Kurashige et al. ..... 101/120
6,067,902 A 5/2000 Takahashi
6,213,014 B1 * 4/2001 Motoe et al. ..... 101/116

FOREIGN PATENT DOCUMENTS

JP 60-145069 9/1985
JP 64-18682 1/1989
JP 5-229243 9/1993
JP 6-24117 2/1994
JP 10-305649 11/1998
JP 11-48595 2/1999

* cited by examiner

*Primary Examiner*—John S. Hilten
*Assistant Examiner*—Kevin D. Williams
(74) *Attorney, Agent, or Firm*—Oblon, Spivak, McClelland, Maier & Neustadt, P.C.

(57) ABSTRACT

A stencil printer of the type including a print drum around which a master is to be wrapped is disclosed. A press roller presses a paper sheet or similar recording medium against the master wrapped around the print drum. A press roller displacing device moves the press roller between an operative position where it presses the recording medium against the master and an inoperative position where it is spaced from the print drum. A press roller driving device causes the press roller held at the inoperative position to rotate, at a position where the roller faces the print drum, in the same direction as the direction in which the drum rotates during printing. The press roller driving device causes the press roller to rotate only when the roller is held at the inoperative position. The printer is capable of effecting preliminary rotation of the press roller at a stable, accurate speed with a relatively simple configuration while freeing the master, recording medium and print drum from loads.

13 Claims, 5 Drawing Sheets

FIG. 4

| | RATIO OF PRESS ROLLER SPEED TO PRINT DRUM SPEED | | | |
|---|---|---|---|---|
| | 0.9 | 1.0 | 1.1 | 1.2 |
| TEAR OF MASTER FILM | X | X | O | X |
| CREASE OF MASTER LEADING EDGE | X | X | O | O |

O : NO TEAR OR CREASE

X : TEAR OR CREASE

STENCIL PRINTER

BACKGROUND OF THE INVENTION

The present invention relates to a stencil printer for printing an image on a paper sheet or similar recording medium with a master perforated by a thermal head or similar heat generating device and wrapped around a print drum.

A digital thermal stencil printer using a thermal head is conventional. The thermal head includes fine heat generating elements arranged in the main scanning direction. While a stencil is conveyed along a preselected path, current in the form of pulses is selectively fed to the heat generating elements contacting the stencil in accordance with image data, thereby perforating the stencil. The perforated stencil (master hereinafter) is wrapped around a hollow cylindrical, porous print drum. A press drum pressed against the print drum is rotated to cause ink to be transferred from the print drum to a paper sheet via the perforations of the master, so that an image is printed on the paper sheet.

Usually, the press roller is movable into an out of contact with the print drum in synchronism with the rotation of the print drum. Specifically, when the ink should be transferred from the print drum to the paper sheet, the press roller is pressed against and rotated by the print drum. When the press roller is being moved toward the print drum without being rotated, the former is rotating in the opposite direction relative to the latter. This brings about a problem that when the press roller contacts the non-perforated portion (non-image portion) of the master, it pulls the master in the direction opposite to the direction of rotation of the print drum, tearing the master or pulling it out of a master clamper. Further, on contacting the paper sheet, the press roller displaces or tears the paper sheet in addition to the master. In any case, a high quality image is not achievable with the above-described configuration.

In light of the above, a mechanism has been proposed for causing, before the press roller is moved toward the print drum, the roller to rotate in the direction in which the print drum rotates during printing. This kind of mechanism is disclosed in, e.g., Japanese Utility Model Laid-Open Publication No. 60-145069 and Japanese Patent Laid-Open Publication Nos. 6-24117 and 10-305649. Let the above rotation of the press roller be referred to as preliminary rotation hereinafter.

Specifically, the above Laid-Open Publication No. 60-145069 shows in FIG. 1 thereof a first preliminary rotation mechanism in which a print drum 1 is provided with a preliminary rotation rubber 23. In this mechanism, a press roller 18 contacts the preliminary rotation rubber 23 while moving toward the print drum 1 and is caused to rotate thereby. The same document shows in FIGS. 2 and 3 thereof a second preliminary rotation mechanism including a support arm 7 supporting a press roller 8 and provided with a device for rotating the press roller 8. The second mechanism rotates the press roller 8 while moving it toward the print drum 1.

Laid-Open Publication No. 6-24117 teaches a third preliminary rotation mechanism including drive source assigned to a press roller in addition to a drive source assigned to a print drum, and a device for controlling the output torque of the drive source in accordance with the position of the press roller relative to the print drum. The third mechanism also rotates the press roller while moving it toward the print drum. Laid-Open Publication No. 10-305649 shows in, e.g., FIG. 2 thereof a fourth preliminary rotation mechanism in which conveying means 17*a* for conveying a paper sheet causes a press roller 9*a* being moved toward a print drum la to rotate. However, a problem with the first preliminary rotation mechanism is that every time the press roller 18 contacts the preliminary rotation rubber 23, it presses the print drum 1 via the rubber 23 and thereby deforms the drum 1 while adversely effecting the positional accuracy of the drum 1. Another problem with this mechanism is that the print drum 1 is not applicable to a stencil printer using a press drum, as taught in, e.g., Japanese Patent Laid-Open Publication No. 11-48595. The second and third preliminary rotation mechanisms each need a sophisticated configuration. The fourth preliminary rotation mechanism makes the rotation speed of the press roller 9*a* unstable because it causes the press roller 9*a* to rotate while moving it toward the print drum 1*a*.

Technologies relating to the present invention are also disclosed in, e.g., Japanese Patent Laid-Open Publication Nos. 64-18682 and 5-229243.

SUMMARY OF THE INVENTION

It is therefore an object of the present invention to provide a stencil printer capable of effecting the preliminary rotation of a press roller at a stable, accurate speed with a relatively simple configuration while freeing a master, a paper sheet and a print drum from loads.

In accordance with the present invention, a stencil printer of the type including a print drum around which a master is to be wrapped has a press roller for pressing a paper sheet or similar recording medium against the master wrapped around the print drum. A press roller displacing device moves the press roller between an operative position where it presses the recording medium against the master and an inoperative position where it is spaced from the print drum. A press roller driving device causes the press roller held at the inoperative position to rotate, at a position where the roller faces the print drum, in the same direction as the direction in which the drum rotates during printing. The press roller driving device causes the press roller to rotate only when the roller is held at the inoperative position.

BRIEF DESCRIPTION OF THE DRAWINGS

The above and other objects, features and advantages of the present invention will become more apparent from the following detailed description taken with the accompanying drawings in which:

FIG. 4 is a table showing a relation between the ratio of the peripheral speed of the press roller to that of a print drum and the tearing of a master and the creasing of the leading edge of the same.

DESCRIPTION OF THE PREFERRED EMBODIMENT

Figure 1:
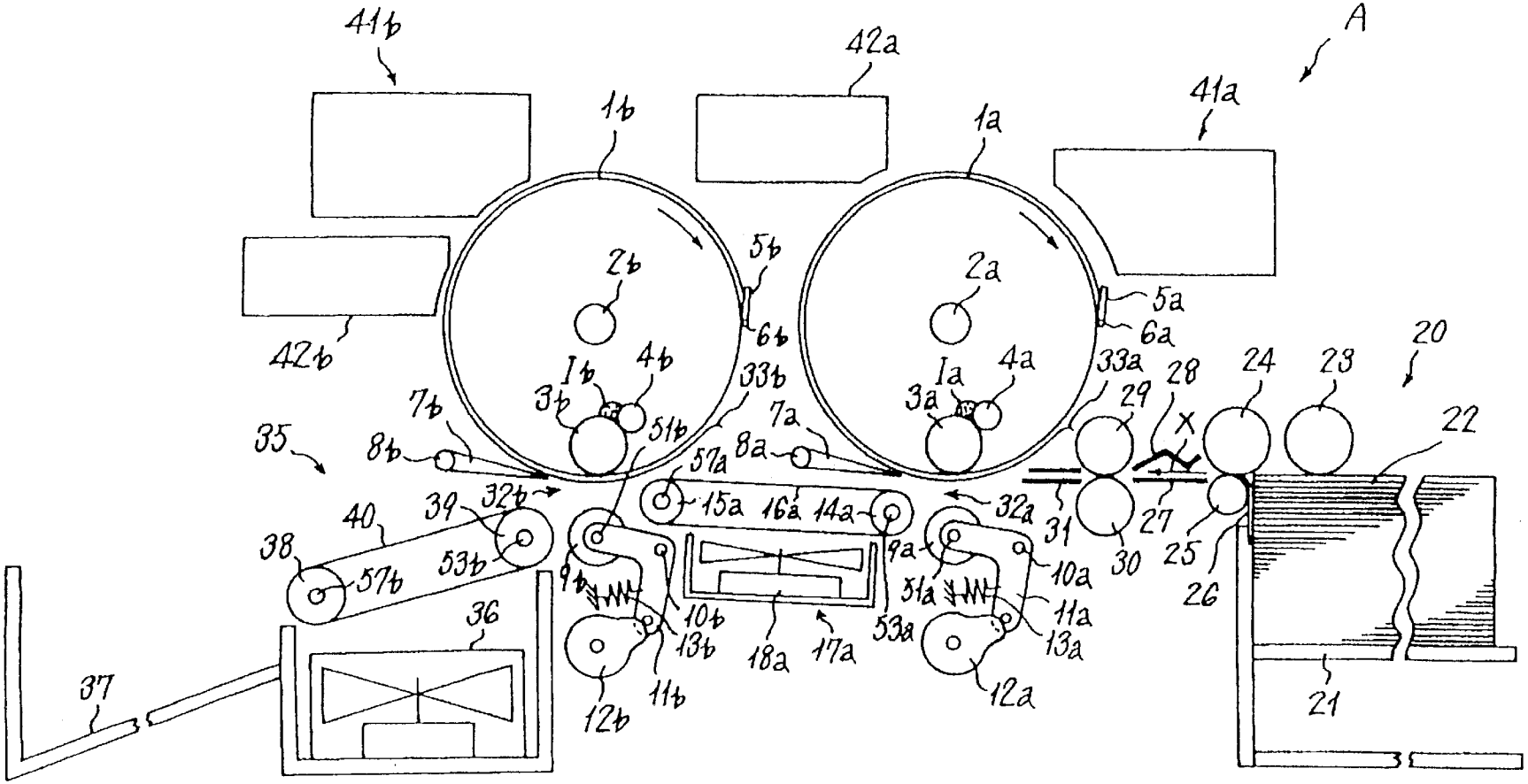
FIG. 1 is a side elevation showing a stencil printer embodying the present invention.

Referring to FIG. 1 of the drawings, a stencil printer embodying the present invention is shown and implemented as a two-drum type stencil printer by way of example. As shown, the printer, generally labeled A, includes a first print drum 1*a* and a second print drum 1*b* spaced from each other in a direction of paper conveyance X. In this sense, the print drums 1*a* and 1*b* are located at the upstream side and downstream side, respectively. With the two print drums 1*a* and 1*b,* the printer A is capable of printing a bicolor image on a paper sheet or similar recording medium 22. The print drums 1*a* and 1*b* are identical in configuration.

Ink feeding means, a master making device, a master discharging device, a press roller, conveying means and drive transmitting means for transmitting the drive force of the conveying means to the press roller are assigned to the print drum 1*a* and respectively substantially identical in configuration and function with corresponding ones assigned to the print drum 1*b*. Such two groups of components are therefore distinguished from each other by suffices a and b (as well as by suffixes c and d in FIG. 5) attached to the reference numerals, and only one of the two groups will be described as far as possible in order to avoid redundancy. So long as such distinction is not necessary, description common to the two groups will be made without any suffix.

The stencil printer A has a conventional integrated structure with a digital master making capability. Specifically, the print drum 1*a* allows a master 33*a* to be wrapped therearound. A master making device 41*a* for making the master 33*a* is positioned above and rightward of the print drum 1*a*. A paper tray 21 is positioned below the master making device 41*a* and loaded with a stack of paper sheets 22. A paper feeder 20 sequentially feeds the paper sheets 22 from the paper tray 21 one by one. A master discharging device 42*a* is located above and leftward of the print drum 1*a* and peels off the used master 33*a* wrapped around the drum 1*a* and discharges it. A pressing device 32*a* is positioned below the print drum 1*a* for pressing the paper sheet 22 fed from the paper tray 21 against the master 33*a* that exists on the print drum 1*a*. An air knife 7*a* peels from the print drum 1*a* the paper sheet 22 carrying an ink image transferred from the print drum 1*a*. Another master 33*b* is wrapped around the print drum 1*b*. A master making device 41*b* for making the master 33*b* is located above and leftward of the print drum 1*b*. A master discharging device 42*b* for peeling off the used master 33*b* from the print drum 1*b* is located at the left-hand side of the print drum 1*b*. A pressing device 32*b* is positioned below the print drum 1*b* for pressing the paper sheet 22 against the master 33*b*. An intermediate conveying device or conveying means 17*a* intervenes between the pressing devices 32*a* and 32*b* for conveying the paper sheet 22 from the pressing device 32*a* to the pressing device 32*b*. An air knife 7*b* peels off the paper sheet 22 carrying an ink image transferred from the print drum 1*b* over the previous ink image from the print drum 1*a*. A paper discharging device 35 is positioned below the master discharging device 42*b* for discharging the paper sheet or bicolor print 22 to a print tray 37. The paper discharging device 35 includes the air knife 7*b*.

A scanner or document reading device, not shown, is positioned above the master masking devices 41*a* and 41*b* and master discharging device 42*a*. The scanner reads an image out of a document not shown.

The operation of the stencil printer A will be described hereinafter together with details of each device. The print drum 1*a* is a conventional porous hollow cylinder and rotatably mounted on a shaft 2*a*. A main motor, not shown, causes the print drum 1*a* to rotate. An openable clamper 5*a* is mounted on the print drum 1*a* and extends in the axial direction of the print drum 1*a*. The clamper 5*a* clamps the leading edge of the master 33*a* when closed. Specifically, the clamper 5*a* is angularly movably mounted on the print drum 1*a* via a shaft 6*a*. Opening/closing means, not shown, is positioned at an adequate position around the print drum 1*a* for causing the clamper 5*a* to open and close at a preselected position. An ink roller 3*a* is disposed in the print drum 1*a* and plays the role of ink feeding means for feeding ink of a first color from the inner periphery to the outer periphery of the print drum 1*a*. The ink of the first color to be fed by this ink feeding means is, e.g., black. Ink feeding means disposed in the print drum 1*b* feeds ink of a second color, e.g., magenta from the inner periphery to the outer periphery of the print drum 1*b*.

The master 33*a* may be made up of a film formed of polyester or similar thermoplastic resin and Japanese paper or similar support adhered to the film. Alternatively, the master 33*a* may consist substantially only of an extremely thin, thermoplastic resin film.

The operator of the printer A lays a desired document on a document tray, not shown, included in the scanner and then presses a perforation start key for causing the printer A to perform a master making operation. In response, the printer A performs a master making operation for both of the print drums 1*a* and 1*b*. Specifically, the print drum 1*a* is rotated in the direction (counterclockwise) opposite to the direction indicated by an arrow in FIG. 1. The master discharging device 42*a* peels off the used master 33*a* existing on the print drum 1*a* and discharges it into a box not shown. This is the end of a master discharging step.

In parallel with the master discharging step, the scanner is caused to read the document with a conventional reduction type of document reading system. An image read by the scanner is photoelectrically converted by an image sensor, e.g., a CCD (Charge Coupled Device) image sensor not shown. The resulting electric image signal is digitized by an analog/digital (A/D) conversion board not shown.

The scanner includes an arrangement having various functions for color separation necessary for color printing, e.g., an arrangement similar to a filter unit disclosed in, e.g., Japanese Patent Laid-Open Publication No. 64-18682 mentioned earlier. The filter unit is capable of selectively using a plurality of color filters. Such an arrangement is positioned on an optical path between a group of mirrors and a lens not shown. The printer A automatically executes master making, paper feed and so forth in the same manner as in the above document, although not shown or described specifically.

In parallel with the operation of the scanner, the master making devices 41*a* and 41*b* both perform a master making and master feeding operation in accordance with the digitized image signal. Specifically, the master making device 41*a* includes a flat thermal head and a platen roller pressed against the thermal head, although not shown specifically. The platen roller and a feed roller pair, not shown, cooperate to convey the master 33*a* to the downstream side. At this instant, fine heat generating elements arranged on the head in an array in the main scanning direction selectively generate heat in accordance with the digital image signal and thereby perforate the thermoplastic resin film of the master 33*a*. As a result, an image represented by the image signal is formed in the master 33*a* in the form of a perforation pattern.

The feed roller pair in rotation conveys the leading edge of the perforated master 33*a* toward the print drum 1*a*. At this instant, the print drum 1*a* is held in a master feed position shown in FIG. 1 with its clamper 5*a* being opened. A guide, not shown, steers the master 33*a* such that the master 33*a* hangs down toward the open clamper 5*a*. At this time, the used master 33*a* has already been removed from the print drum 1*a* by the previously stated master discharging step.

Likewise, the leading edge of the master 33*b* is conveyed toward the outer periphery of the print drum 1*b* by a feed roller, not shown, and then steered by a guide, not shown, toward a clamper 5*b* mounted on the print drum 1*b* and held in its open position.

The clamper 5*a* clamps the leading edge of the master 33*a* at a preselected timing. Subsequently, the print drum 1*a* is rotated clockwise, as indicated by the arrow in FIG. 1, sequentially wrapping the master 33*a* therearound. Cutting means, not shown, made up of a movable edge and a stationary edge is included in the master making device 41*a* and cuts the trailing edge of the master 33*a* at a preselected length. A master feeding step ends when the entire master 33*a* is fully wrapped around the print drum 1*a*.

After the masters 33*a* and 33*b* have been respectively wrapped around the print drums 1*a* and 1*b*, a printing step begins. Specifically, the paper tray 21 is raised beforehand to a position where the top paper sheet 22 on the tray 21 contacts a pickup roller 23. The pickup roller 23 is rotated to pay out the top paper sheet 22 contacting it. A pair of separator rollers 24 and 25 and a separator plate 26 cooperate to separate the top paper sheet 22 from the underlying paper sheets 22. The top paper sheet 22 is therefore conveyed in the direction of paper conveyance X toward a pair of registration rollers 29 and 30 while being guided by an upper guide plate 28 and a lower guide plate 27. The leading edge of the paper sheet 22 is stopped by a portion of the registration rollers 29 and 30 just short of a nip between the rollers 29 and 30, forming a loop along the upper guide plate 28.

When a printing operation begins, the print drum 1*a* assigned to the first color, i.e., black is caused to start rotating at a preselected printing speed. The ink roller 3*a* disposed in the print drum 1*a* forms an ink well 1*a* between it and a doctor roller 4*a*. An ink distributor, not shown, feeds black ink to the ink well 1*a*. The ink uniformly deposits on the ink roller 3*a* while being kneaded by the ink roller 3*a* and doctor roller 4*a* in rotation.

Ink sensing means (see, e.g., FIG. 2 of Japanese Patent Laid-Open Publication No. 5-229243 mentioned earlier) senses the amount of black ink remaining in the print drum 1*a*. When the ink is short, the ink distributor replenishes black ink to the print drum 1*a*. The ink roller 3*a* rotates in the same direction as and in synchronism with the rotation of the print drum 1*a*, feeding the ink to the inner periphery of the print drum 1*a*.

The pressing device 32*a* mainly consists of the ink roller 3*a*, a press roller 9*a*, a bracket 11*a*, a tension spring 13*a* and a sector cam 12*a*. The press roller or pressing means 9*a* presses the paper sheet 22 conveyed thereto against the print drum 1*a* via the master 33*a*, so that an image is printed on the paper sheet 22. Part of the pressing device 32*a* other than the ink roller 3*a* and press roller 9*a* constitutes press roller displacing means for displacing the press roller 9*a* between an operative position or pressing position and an inoperative position or stand-by position. The press roller 9*a* presses the paper sheet 22 against the master 33*a* at the operative position or remains spaced from the print drum 1*a* at the inoperative position.

Figure 2:
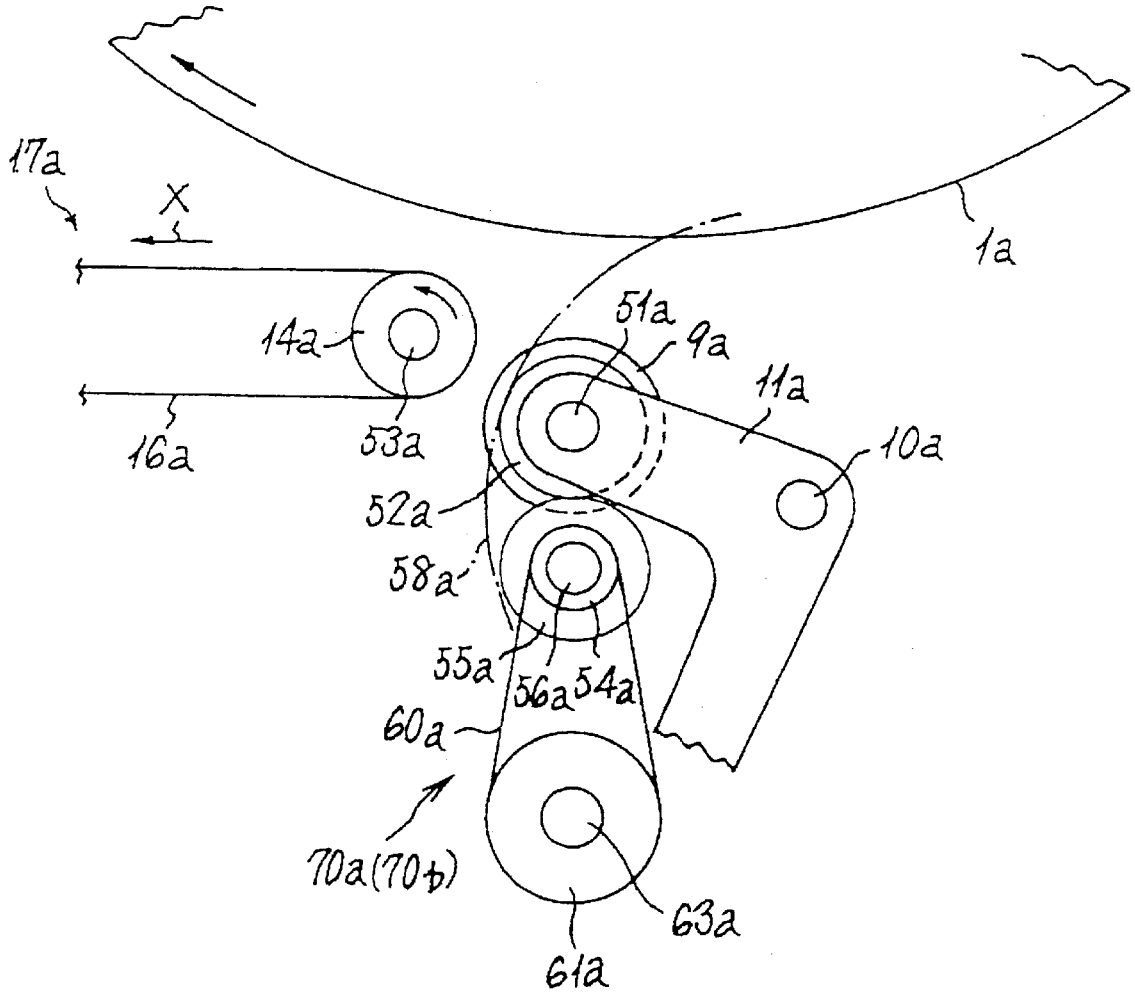
FIGS. 2 and 3 are respectively a side elevation and an isometric view showing a press roller included in the illustrative embodiment and performing preliminary rotation at an inoperative or stand-by position assigned thereto.

The inoperative position of the press roller 9*a* mentioned above refers to a position that one of opposite ends of the press roller 9*a* remote from the pressing position occupies within the movable range of the press roller 9*a*. More specifically, in the illustrative embodiment, the inoperative position refers to the lowermost position of the above end of the press roller 9*a*. Stated another way, the press roller 9*a* remains at the pressing position when pressing the paper sheet 22 against the print drum 1 or remains at a home position when otherwise. As shown in FIG. 2, the press roller 9*a* is mounted on a shaft 51*a*. Opposite ends of the shaft 51*a* are rotatably supported by one end of the bracket 11*a* such that the press roller 9*a* is movable into and out of contact with the print drum 1*a*.

Figure 3:
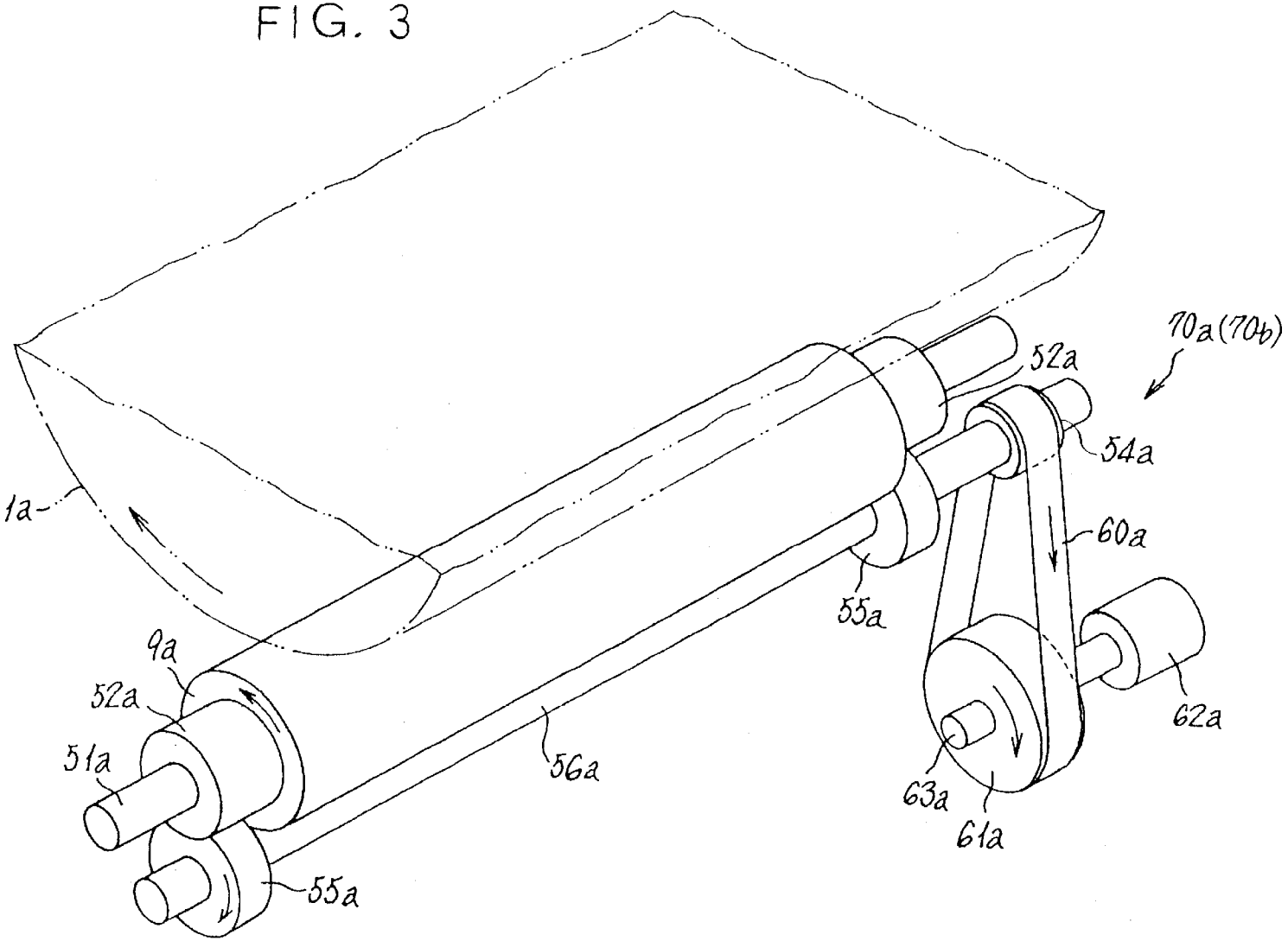

As shown in FIG. 3, two rubber pulleys or rubber rings 52*a* are respectively positioned at opposite sides of the press roller 9*a* integrally and coaxially with the press roller 9 and shaft 51*a*. Each rubber pulley 52*a* is a driven member and smaller in diameter than the press roller 9*a*. The press roller 9 extends in the axial direction of the print drum 1*a* (perpendicular to the sheet surface of FIG. 1) in such a manner as to include a preselected printing range in which the print drum 1*a* can print an image. More specifically, the printing range corresponds to the maximum perforation range available with the master 33*a* to be wrapped around the print drum 1*a*. The rubber pulleys 52 are located outside of the printing range.

As shown in FIG. 1, the tension spring 13*a* is anchored to the other end portion of the bracket 11*a* and determines a pressure that the press roller 9*a* exerts on the print drum 1*a*. Also, the tension spring 13*a* constantly biases the bracket 11*a* such that the other end of the bracket 11*a* is pressed against the profile of the sector cam 12*a*.

The intermediate conveying device 17*a* is located downstream of the press roller 9*a* in the direction of paper conveyance X. The conveying device 17*a* mainly consists of a porous belt 16*a* passed over a drive roller 15*a* and a driven roller 14*a* and a suction fan 18*a*. The belt 16*a* is movable in synchronism with the rotation of the print drum 1*a* at a slightly higher conveying speed than the drum 1*a*. The drive roller 15*a* is mounted on a shaft 57*a*. The belt 16*a* conveys the paper sheet 22 carrying an image thereon while retaining it thereon by suction. The conveying device 17*a* can therefore surely convey the paper sheet 22 without suffering from smears particular to conveying means implemented by roller pairs. This is also true with the paper discharging device 35 that will be described specifically later.

A driveline, not shown, associated with the previously mentioned main motor causes the sector cam 12*a* to rotate in synchronism with the feed of the paper sheet 22 from the paper feeder 20 and the rotation of the print drum 1*a*. When the paper feeder 20 does not feed the paper sheet 22, the sector cam 12*a* is held stationary with a larger diameter portion thereof contacting the end of the bracket 11*a* adjoining it. The bracket 11*a* is therefore rotated counterclockwise about a shaft 10*a*. Consequently, as shown in FIG. 2, the rubber pulleys 52*a* are moved downward along a locus 58*a* along which the points of the pulleys 52*a* remotest from the shaft 10*a* move about the shaft 10*a*. When the press roller 9*a* reaches its inoperative or stand-by position, the rubber pulleys 52*a* respectively contact associated rubber pulleys 55*a* with the result that the press roller 9*a* is caused to rotate.

More specifically, the rubber pulleys 52*a* contact the rubber pulleys or drive members 55*a* only when the press roller 9*a* is held at the inoperative position. For this purpose, press roller drive means 70*a* interrupts drive transmission to the press roller 9*a* when the roller 9*a* is held at the operative or pressing position and when press roller displacing means is moving the press roller 9*a*. The drive means 70*a* drives the press roller 9*a* only when the roller 9*a* reaches the inoperative position. The master, paper sheet and ink roller are not shown in FIG. 2 or 3.

As shown in FIGS. 2 and 3, press roller displacing means 70*a* causes the press roller 9*a* reached the inoperative position to rotate, at a position where the roller 9*a* faces the print drum 1*a,* in the same direction as the direction in which the drum 1*a* rotates during printing. The press roller drive means 70*a* includes the rubber pulleys or drive members 55*a* for transferring a torque to the rubber pulleys 52*a* when contacting the pulleys 52*a*. The rubber pulleys 55*a* are mounted on a shaft 56*a*. A pulley 54*a* is mounted on one end of the shaft 56*a*. A motor 62*a* has an output shaft 63*a* on which a pulley 61*a* is mounted. An endless belt 60*a* is passed over the pulleys 54*a* and 61*a*. The rubber pulleys 52*a* and 55*a* adjoining each other are located at substantially the same position in the axial direction of the shafts 51*a* and 56*a* that are parallel to each other. This is also true with the pulleys 54*a* and 61*a*.

In the configuration shown in FIG. 3, the output torque of the motor 62*a* is transferred to the press roller 9*a* via the pulley 61*a,* endless belt 60*a,* pulley 54*a,* shaft 56*a,* rubber pulleys 55*a* and rubber pulleys 52*a*. The press roller drive means 70*a* therefore causes the press roller 9*a* to rotate in the same direction as the print drum 1*a,* as seen at the position where the roller 9*a* and drum 1*a* face each other. This is the preliminary rotation of the press roller 9*a*.

While the illustrative embodiment causes the press roller 9*a* to rotate in the inoperative position at a peripheral speed, or linear velocity, 1.1 times as high as the peripheral speed of the print drum 1*a,* the crux is that the former be substantially equal to or higher than the latter. However, as FIG. 4 indicates, a series of experiments showed that the peripheral speed of the press roller 9*a* should preferably be more than one time, but less than 1.2 times, as high as the peripheral speed of the print drum 1*a*. More preferably, the peripheral speed of the press roller 9*a* should be 1.05 times to 1.15 times as high as the peripheral speed of the print drum 1*a,* as also determined by experiments. Such a peripheral speed range of the press roller 9*a* can be easily implemented on the basis of, e.g., a diameter ratio between the rubber pulleys 52*a* and 55*a*.

In the illustrative embodiment, the rubber pulleys 52*a* and 55*a* are separable from the press roller 9*a* and press roller drive means 70*a*. In addition, a group of rubber pulleys 52*a* each having a particular diameter and a group of rubber pulleys 55*a* each having a particular diameter are prepared. By combining the rubber pulleys 52*a* and 55*a* of desired diameters, it is possible to vary the rotation speed of the press roller 9*a*. If desired, an arrangement may be made such that only the rubber pulleys 52*a* or the rubber pulleys 55*a* are separable from the press roller 9*a* or the press roller drive means 70*a,* respectively. Further, the rotation speed of the motor 62*a* itself may be varied to vary the rotation speed of the press roller 9*a*. At the same time, such replaceable rubber pulleys 52*a* and 55*a* contribute to efficient maintenance when they are deteriorated due to aging, e.g., wear.

The paper sheet 22 is fed from the paper feeder 20 via the registration rollers 29 and 30 and a guide 31 in synchronism with the rotation of the print drum 1*a*. In response, the sector cam 12*a* is rotated such that its smaller diameter portion contacts the end of the bracket 11*a,* causing the bracket 11*a* to rotate clockwise about the shaft 10*a*. As a result, the press roller 9*a* mounted on the bracket 11*a* is moved into contact with the print drum 1*a*. At the same time, the rubber pulleys 52*a* are moved upward along the locus 58*a*.

The press roller 9*a* is caused to rotate beforehand (preliminary rotation), as stated above. At the moment when the press roller 9*a* contacts the master 33*a* wrapped around the print drum 1*a,* it is moving at a higher peripheral speed than the master 33*a*. However, the peripheral speed of the press roller 9*a* in the inoperative position is selected to be 1.1 times as high as the peripheral speed of the print drum 1*a,* as stated previously. The press roller 9*a* therefore begins to be rotated by the master 33*a* without shifting the master 33*a* or causing any critical stress to act in the print drum 1*a*. While the rotation speed of the press roller 9*a* slightly decreases during the movement from the inoperative position to the operative position of the roller 9*a,* the rotation speed of the roller 9*a* assigned to the inoperative position is selected in due consideration of such an occurrence.

The press roller 9*a* presses the master 33*a* toward the print drum 1*a* and causes the ink to penetrate a porous portion included in the print drum 1*a*. As a result, the master 33*a* closely adheres to the print drum 1*a* due to the viscosity of the ink. The ink is transferred from the print drum 1*a* to the paper sheet 22 via the perforation pattern of the master 33*a,* forming an image of the first color on the paper sheet 22.

When the leading edge of the paper sheet 22 carrying the image of the first color thereon approaches the edge of the air knife 7*a,* the air knife 7*a* rotates about a shaft 8*a* to a position close to the print drum 1*a* in synchronism with the rotation of the print drum 1*a*. A compressed air source feeds air under pressure to the air knife 7*a*. As a result, a jet of air is sent via the edge of the air knife 7*a* so as to peel off the leading edge of the paper sheet 22 from the print drum 1*a*. At the same time, the press roller 9*a* is retracted to its inoperative position. The intermediate conveying device 17*a* conveys the paper sheet 22 to the downstream side in the direction of paper conveyance X. Specifically, the belt 16*a,* turning counterclockwise, conveys the paper sheet 22 toward the pressing device 32*b* while retaining it thereon due to the operation of the suction fan 18*a*.

The print drum 1*b* starts rotating at the preselected printing speed in synchronism with the print drum 1*a*. An ink roller 3*b* rotates in contact with the inner periphery of the drum 1*b* in synchronism with the rotation of the drum 1*b*. The ink roller 3*b* feeds ink of the second color, i.e., magenta to the inner periphery of the drum 1*b* in the same manner as the ink roller 3*a* feeds the ink of the first color to the print drum 1*a*.

The belt 16*a* of the intermediate conveying device 17*a* brings the paper sheet 22 to a gap between the print drum 1*b* and a press roller 9*b* at a preselected timing synchronous to the rotation of the print drum 1*b*. At this time, the press roller 9*b* is angularly moved upward and pressed against the master 33*b* existing on the print drum 1*b*. The press roller 9*b* is rotated beforehand (preliminary rotation) by a mechanism identical with the preliminary rotation mechanism assigned to the press roller 9*a*. The press roller 9*b* therefore does not adversely effect the master 33*b* or the print drum 1*b*.

The press roller 9*b* presses the master 33*b* toward the print drum 1*b* and causes ink of the second color to penetrate a porous portion included in the print drum 1*b*. As a result, the master 33*b* closely adheres to the print drum 1*b* due to the viscosity of the ink. The ink is transferred from the print drum 1*b* to the paper sheet 22 via the perforation pattern of the master 33*b,* forming an image of the second color on the paper sheet 22 over the image of the first color. As a result, a bicolor image is printed on the paper sheet 2.

Subsequently, when the leading edge of the paper sheet or bicolor print 22 approaches the edge of the air knife 7*b,* the air knife 7*b* rotates about a shaft 8*b* to a position close to the print drum 1*b* in synchronism with the rotation of the print drum 1*b*. The compressed air source feeds air under pressure to the air knife 7*b* also. As a result, a jet of air is sent via the edge of the air knife 7*b* so as to peel off the leading edge of the paper sheet 22 from the print drum 1*b*. The paper discharging device 35 conveys the paper sheet 22 separated from the print drum 1*b* to the print tray 37 in the direction of paper conveyance X. Specifically, the paper discharging device 35 includes a belt 40 passed over a drive roller 38 and a driven roller 39 and a suction fan 36. The belt 40 is caused to move in synchronism with the print drum 1*b* at a slightly higher speed than the master 33*b* wrapped around the drum 1*b*.

Two rubber pulleys or rubber rings 52*b* are respectively positioned at opposite sides of the press roller 9*b* integrally and coaxially with the press roller 9*b* and a shaft 51*b* although not shown specifically. Arrangements around the press roller 9*b* and press roller drive means 70*b* are respectively identical with the arrangements around the press roller 9*b* and the press roller drive means 70*b* and will not be described specifically in order to avoid redundancy. In FIG. 1, the reference numeral 57*b* designates a shaft on which the drive roller 38 is mounted.

The belt 40, turning counterclockwise, conveys the paper sheet 22 separated from the print drum 1*b* toward the print tray 37 while retaining it thereon due to the operation of the suction fan 36. In this manner, a trial printing step is executed.

If the bicolor trial print is acceptable, the operator inputs a desired number of prints on numeral keys arranged on an operation panel, not shown, and then presses a print start key not shown. In response, the paper feed, printing and paper discharge described above are repeated a number of times corresponding to the desired number of prints.

In the illustrative embodiment, the press roller 9 extends in such a manner as to include the printing range while the rubber pulleys 52 are located outside of the printing range, as stated earlier. Alternatively, the press roller 9 may have a dimension substantially coinciding with the printing range, in which case, too, the rubber pulleys 52 will be positioned outside of the printing range. The diameter of the rubber pulleys 52 should only be smaller than the diameter of the press rollers 9.

Figure 5:
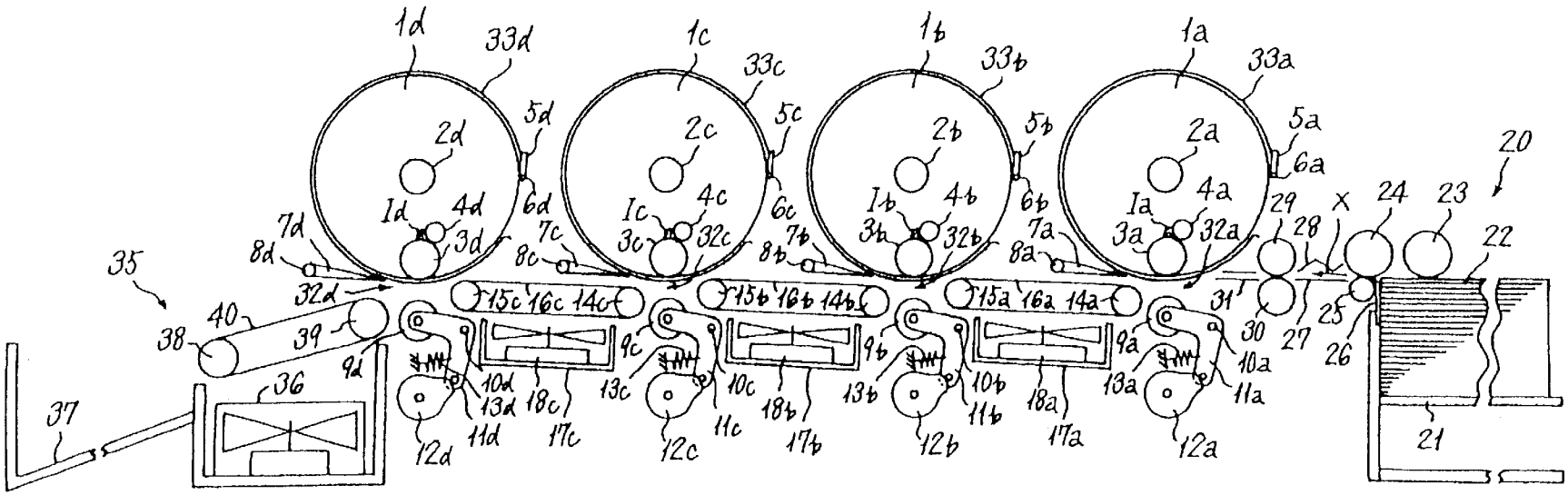
FIG. 5 is a side elevation showing an alternative embodiment of the present invention.

FIG. 5 shows an alternative embodiment of the present invention implemented as a full-color stencil printer having four print drums 1*a* through 1*d*. The print drums 1*a* through 1*d* are respectively assigned to yellow, cyan, magenta and black. Of course, the stencil printer shown in FIG. 5 includes additional master making devices, master discharging devices, preliminary rotation mechanisms, intermediate conveying devices and pressing devices due to the increase in the number of print drums. The number of print drums may be further increased in order to enhance image quality. For example, with six print drums, it is possible to superpose extra colors on a full-color print. In such a case, too, each master to be wrapped around the respective print drum is perforated by color separation and color designation matching with a particular color.

While the master making devices and master discharging devices are not shown in FIG. 5, structural elements identical with the structural elements of the illustrative embodiment are designated by identical reference numerals. Again, press roller drive means are arranged in one-to-one correspondence to the press rollers.

If desired, the present invention may be applied to a stencil printer including a single print drum or a stencil printer of the type including two print drums, but not including a paper discharging device. In this type of stencil printer, a paper sheet or print to which an image has been transferred from the most downstream print drum is directly driven out to a print tray.

The configurations and arrangements of the devices constituting the printer A, FIG. 1, are only illustrative and may be replaced with any other conventional configurations and arrangements. The air knives 7, for example, may be replaced with conventional peelers each adjoining the respective print drum 1.

The printer A is not limited to the integrated type of stencil printer with a digital master making capability shown and described. For example, in a stencil printer of the type having the individual print drum 1 implemented as a drum unit removable from the printer body, a master may be made by and then fed from a master making device independent or the printer body or may be removed from the drum 1 and then discharged by a master discharging device independent of the printer body, although not shown specifically. That is, the mater making devices 41 and master discharging devices 42 do not have to be mounted on the printer body. Also, the data output from the scanner may be replaced with data output from, e.g., a computer.

While each press roller 9 has been shown and described as contacting the non-perforated portion of the master 33 when moved to the operative position, the roller 9 may alternatively contact the paper sheet 22 brought to between it and the master 33. The rubber pulleys 52 are not essential if the wear of the press rollers 9 does not have to be considered. Specifically, when each press roller 9 extends to the outside of the printing range, the rubber pulleys 55 may be so positioned as to contact the end portions of the press roller 9 outside of the printing range.

In summary, it will be seen that the present invention provides a stencil printer having various unprecedented advantages, as enumerated below.

(1) When a press roller is located at an operative or pressing position and when press roller displacing means is moving the press roller toward the operative position, press roller drive means interrupts drive transmission to the press roller. The printer can therefore cause the press roller to perform preliminary rotation at a stable, accurate speed with a relatively simple configuration. The press roller in preliminary rotation starts exerting a pressure on a print drum and therefore exerts no loads on a stencil, a paper sheet and the print drum. This is successful to prevent the master from shifting, slipping out of a damper or tearing, to prevent the paper sheet from shifting or tearing, and to protect the print drum from deformation and dislocation. The printer therefore insures desirable printing.

(2) The optimal rotation speed of the press roller can be easily set.

(3) Drive members can cause the press roller held at its inoperative or stand-by position to rotate.

(4) Driven members to be caused to rotate are replaceable when worn out. It follows that the press roller, which is comparatively expensive, does not wear. This, coupled with the replacement of the driven members less expensive than the press roller, promotes efficient, economical maintenance at the time of replacement.

(5) The driven members are located at positions not effecting image quality and outside of a range corresponding to the print drum. The driven members can therefore be provided with a greater diameter than the press roller.

(6) The driven members do not effect image quality and allow the press roller to evenly press the print drum in the axial direction. This insures an attractive image uniform in image density in the axial direction and high quality.

(7) The driven members are implemented by rubber rings. Therefore, by adequately selecting the kind of rubber, i.e., friction to act between the driven members and drive members, it is possible to desirably transfer a drive force from the drive members to the driven members and to set the rotation speed of the press roller more accurately.

Various modifications will become possible for those skilled in the art after receiving the teachings of the present disclosure without departing from the scope thereof.

What is claimed is:

1. A stencil printer including a print drum around which a master is to be wrapped, comprising:

a press roller for pressing a recording medium against the master wrapped around the print drum;

press roller displacing means for moving said press roller between an operative position where said press roller presses the recording medium against the master and an inoperative position where said press roller is spaced from the print drum; and press roller drive means for causing said press roller held at the inoperative position to rotate, at a position where said press roller faces the print drum, in a same direction as a direction in which said print drum rotates during printing;

said press roller drive means causing said press roller to rotate only when said press roller is held at the inoperative position.

2. A stencil printer as claimed in claim 1, wherein said press roller drive means causes said press roller held at the inoperative position to rotate at a peripheral speed equal to or higher than a peripheral speed of the print drum.

3. A stencil printer as claimed in claim 1, wherein said press roller drive means causes said press roller held at the inoperative position to rotate at a peripheral speed more than one time, but less than 1.2 times, as high as a peripheral speed of the print drum.

4. A stencil printer as claimed in claim 1, wherein said press roller drive means comprises drive members for applying a torque to said press roller.

5. A stencil printer as claimed in claim 4, further comprising driven members arranged integrally and coaxially with said press roller and respectively contacting said drive members only when said press roller is held at the inoperative position.

6. A stencil printer as claimed in claim 5, wherein said driven members are positioned outside of a printing range, in a widthwise direction of the print drum, in which an image can be printed.

7. A stencil printer as claimed in claim 5, wherein said driven members each have a smaller diameter than said press roller.

8. A stencil printer as claimed in claim 5, wherein said driven members comprise rubber rings.

9. A stencil printer as claimed in claim 4, further comprising driven members arranged integrally and coaxially with said press roller and respectively contacting said drive members only when said press roller is held at the inoperative position, said driven members being separable from said press roller.

10. A stencil printer as claimed in claim 9, wherein said driven members are replaceable with other driven members having a different diameter to thereby make a rotation speed of said press roller variable.

11. A stencil printer as claimed in claim 1, wherein said press roller drive means comprises drive members for applying a torque to said press roller, said drive members are separable from said press roller drive means.

12. A stencil printer as claimed in claim 11, wherein said driven members are replaceable with other driven members having a different diameter to thereby make a rotation speed of said press roller variable.

13. A stencil printer including a print drum around which a master is to be wrapped, comprising:

a press roller for pressing a recording medium against the master wrapped around the print drum;

a press roller displacing device for moving said press roller between an operative position where said press roller presses the recording medium against the master and an inoperative position where said press roller is spaced from the print drum; and a press roller driving device for causing said press roller held at the inoperative position to rotate, at a position where said press roller faces the print drum, in a same direction as a direction in which said print drum rotates during printing;

said press roller driving device rotating said press roller only when said press roller is displaced to the inoperative position by the press roller displacing device.

* * * * *